US006015945A

United States Patent [19]

Borisoff

[11] Patent Number: 6,015,945

[45] Date of Patent: Jan. 18, 2000

[54] TREMOLO BRIDGE APPARATUS

[75] Inventor: David J. Borisoff, Romulus, N.Y.

[73] Assignee: Hipshot Products, Inc., Interlaken, N.Y.

[21] Appl. No.: 09/220,881

[22] Filed: Dec. 23, 1998

[51] Int. Cl.[7] ..... G10D 3/00

[52] U.S. Cl. ..... 84/313

[58] Field of Search ..... 84/313

[56] References Cited

U.S. PATENT DOCUMENTS

| | | | |
|---|---|---|---|
| D. 355,433 | 2/1995 | Blanda, Jr. | D17/21 |
| 668,604 | 2/1901 | Russell | 84/320 |
| 2,741,146 | 4/1956 | Fender | 84/313 |
| 2,972,923 | 2/1961 | Fender | 84/313 |
| 3,185,011 | 5/1965 | Anderson | 84/293 |
| 3,241,418 | 3/1966 | Fender | 84/313 |
| 3,248,991 | 5/1966 | Cole | 84/313 |
| 3,411,394 | 11/1968 | Jones | 84/313 |
| 4,171,661 | 10/1979 | Rose | 84/313 |
| 4,453,443 | 6/1984 | Smith | 84/298 |
| 4,497,236 | 2/1985 | Rose | 84/298 |
| 4,555,970 | 12/1985 | Rose | 84/313 |
| 4,638,711 | 1/1987 | Stroh | 84/313 |
| 4,648,304 | 3/1987 | Hoshino et al. | 84/313 |
| 4,677,891 | 7/1987 | Gressett, Jr. et al. | 84/313 |
| 4,869,145 | 9/1989 | Evans | 84/313 |
| 4,903,568 | 2/1990 | Itoh | 84/313 |
| 4,932,302 | 6/1990 | Saijo | 84/313 |
| 4,939,971 | 7/1990 | Satoh | 84/313 |
| 5,046,393 | 9/1991 | Xenidis | 84/313 |
| 5,088,374 | 2/1992 | Saijo | 84/313 |
| 5,088,375 | 2/1992 | Saijo | 84/313 |
| 5,305,675 | 4/1994 | Lasner | 84/313 |
| 5,373,769 | 12/1994 | Sherman | 84/313 |
| 5,413,019 | 5/1995 | Blanda, Jr. | 84/298 |
| 5,419,227 | 5/1995 | Lavineway | 84/313 |
| 5,539,144 | 7/1996 | Sherman | 84/313 |
| 5,708,225 | 1/1998 | Sherman | 84/313 |

FOREIGN PATENT DOCUMENTS

| | | |
|---|---|---|
| 3130187 | 11/1982 | Germany . |
| 683531 | 2/1965 | Italy . |

*Primary Examiner*—Robert E. Nappi
*Assistant Examiner*—Shih-yung Hsieh
*Attorney, Agent, or Firm*—Oppenheimer Wolff & Donnelly LLP

[57] ABSTRACT

A bearing system for a floating bridge tremolo device where a bearing surface carried by the guitar and a rocker surface carried by the bridge cooperate to provide a smooth rolling action, the intersection of the bearing and rocker surfaces with an imaginary plane through a point of contact between the surfaces yielding a straight line in the case of the bearing surface and a smooth continuous curve in the case of the rocker surface, this configuration giving the result that resistance to rocking is minimized.

25 Claims, 5 Drawing Sheets

TREMOLO BRIDGE APPARATUS

BACKGROUND OF THE INVENTION

1. Field of the Invention

The invention relates generally to tremolo devices for stringed instruments. More particularly, the invention relates to a bearing system for supporting a floating bridge tremolo device incorporated in a guitar.

2. Description of the Related Art

Since the 1950's guitars incorporating tremolo devices have been popular, and the effect upon the sound of the guitar a musician can create using such a device has become an integral part of the vocabulary of the guitar. Presently most electric guitars sold have a tremolo device of some kind.

By far the most widely employed type is patterned after that originally invented by Leo Fender disclosed, for example, in U.S. Pat. No. 2,741,146 issued Apr. 10, 1956. As a player presses down on a lever arm or handle, for example, connected to a spring-counterbalanced or "floating" bridge pivotable on a knife-edged bearing, string tension is reduced, causing the pitch to drop or "go flat." Conversely, as the handle is pulled back away from the guitar, string tension is increased causing the pitch to increases or "go sharp." This functionality facilitates a vibrato effect for example. When the player releases the arm, the bridge returns to an equilibrium position or "in-tune" state due to the biasing effect of springs configured to counterbalance the tension of the guitar strings attached to the bridge.

So that this in-tune state can be achieved consistently, a pivot point bearing system is needed that is as friction-free as possible. Leo Fender's original design featured a six-screw knife-edge mount. An improved design was developed by Floyd Rose, as disclosed for example in U.S. Pat. No. 4,171,661. The Rose bearing system incorporates two bearing posts and two specially shaped knife edge bearing points on the bridge.

To maintain proper function of knife-edge pivots, tremolo bridge constructions are conventionally limited to hardenable materials such as hardenable steel alloys. The forces exerted by the combination of the tensioned strings and the counterbalancing springs can exceed 150 pounds. As can be appreciated, the sharper the knife edge (giving better performance) the greater the force per unit area applied at the knife edge bearing contacts which are of course very small in cross-sectional area when the knife edges are sharp. Even hardened steel alloys will eventually fail under the combination of high compressive forces applied, and the cyclic nature of force application due to the tremolo device being rocked back and forth, particularly under vigorous use.

New bearings eventually become dulled and friction increases, causing less than ideal performance in that the tremolo bridge does not consistently return to the precise "in-tune " position at rest. After a period of use the guitar cannot be made to play consistently in tune and consequently the tremolo device must be replaced. This is an expensive procedure.

As can be appreciated, conventional knife-edged designs are inherently problematic in that the better the knife-edge, which minimizes friction, the greater the force per unit area transferred across the bearing contact and the greater the chance for failure of the material from which the knife-edge bearing is made. Very hard materials are needed to resist the forces applied, but the harder the metal used is, generally speaking the less elasticity it has. Since the bearing action is inherently reciprocating, hardness at the expense of elasticity is undesirable. In sum, the conflicting aspirations of design criteria conspire to limit bearing life. This drives costs in terms of replacements needed upwards, and is not desirable.

SUMMARY OF THE INVENTION

It has been recognized that a bearing system which overcomes the difficulties outlined above is desirable. Accordingly the invention is directed to a bearing system for a tremolo bridge of a guitar which includes a bearing surface mountable on a body of a guitar and a rocker element mountable on the tremolo bridge. The rocker element defines a rocker surface contactable to and cooperating with the bearing surface to provide smooth rocking movement of the tremolo bridge. The bearing surface and the rocker surface are configured so that in an assembled bearing system on a guitar, an imaginary plane intersecting the surfaces through a point of contact between them defines two lines having a point of contact, the line defined by the intersection of the imaginary plane with the bearing surface being straight adjacent the point of contact, and the line defined by the intersection of the imaginary plane with the rocker surface defining a continuous curve adjacent the point of contact. As a result, the rocker surface rolls on the bearing surface, minimizing friction.

Moreover, the rocker element can be formed of a different material than the rest of the tremolo bridge, for example rockers can comprise inserts which are carried in sockets incorporated in the tremolo bridge. This allows the bridge to be constructed out of a wide variety of materials, and need not be formed of a hardenable steel alloy for example, as is conventionally used so that knife-edge bearings can be formed in the bridge.

A pivot axis about which the bridge rotates moves slightly in the system of the present invention as the rocker surface rolls back and forth on the bearing surface. Bounding surface portions can be provided which keep the rocker element within a selected area of the bearing surface and provide a position self-adjusting feature. Rocking the bridge to a limit of movement can move the rocker first against a boundary surface and then cause relative slip movement between the rocker element and the bearing surface. When the bridge is thereafter allowed to return to a neutral position the rocker element rolls to a new, more centralized, location. Thereafter it will roll back and forth on the flat-line portion of the bearing surface between the boundary portions without relative slip, providing a smooth rocking action for the tremolo bridge.

The bearing surface can be made flat and the rocker surface cylindrical so that the contact between them essentially comprises a set of points defining a straight line. Furthermore, the bearing system can be configured so that the contact between surfaces approximates a single point. The rocker can be given a spherical shape for example to achieve this later goal. Moreover, contact can be further minimized by making the bearing surface cylindrical with the curvature tending back away, rather than around, the spherical rocker element surface. The bearing surface can comprise a right circular cylinder having a cylindrical axis perpendicular to a pivot axis of the tremolo bridge. In this later example boundary surface portions can comprise frustoconical portions bounding an intermediate cylindrical portion.

The bearing surface can comprise a bearing post adapted to be carried on a guitar body in replacement of a knife-edge bearing post. Moreover, the bearing post of the present invention can be made to be vertically adjustable, and can have a threaded portion allowing it to be threaded into a bearing post support insert in the body of a guitar, the bearing post being symmetrical with respect to a longitudinal axis of symmetry corresponding to the cylindrical axis of the bearing surface. Such a bearing system can be made to be adaptable to existing guitars having bearing post supports receiving threaded bearing posts.

BRIEF DESCRIPTION OF THE DRAWINGS

In order to appreciate the manner in which the advantages and objects of the invention are obtained, a more particular description of the invention will be given by reference to specific embodiments thereof which are illustrated in the appended drawings. Understanding that these drawings only depict presently preferred embodiments of the present invention and are given only by way of example and are not to be considered limiting of its scope, the invention will be described and explained with additional specificity and detail through the use of the accompanying drawings in which.

DETAILED DESCRIPTION OF THE PREFERRED EMBODIMENT(S)

Figure 1:
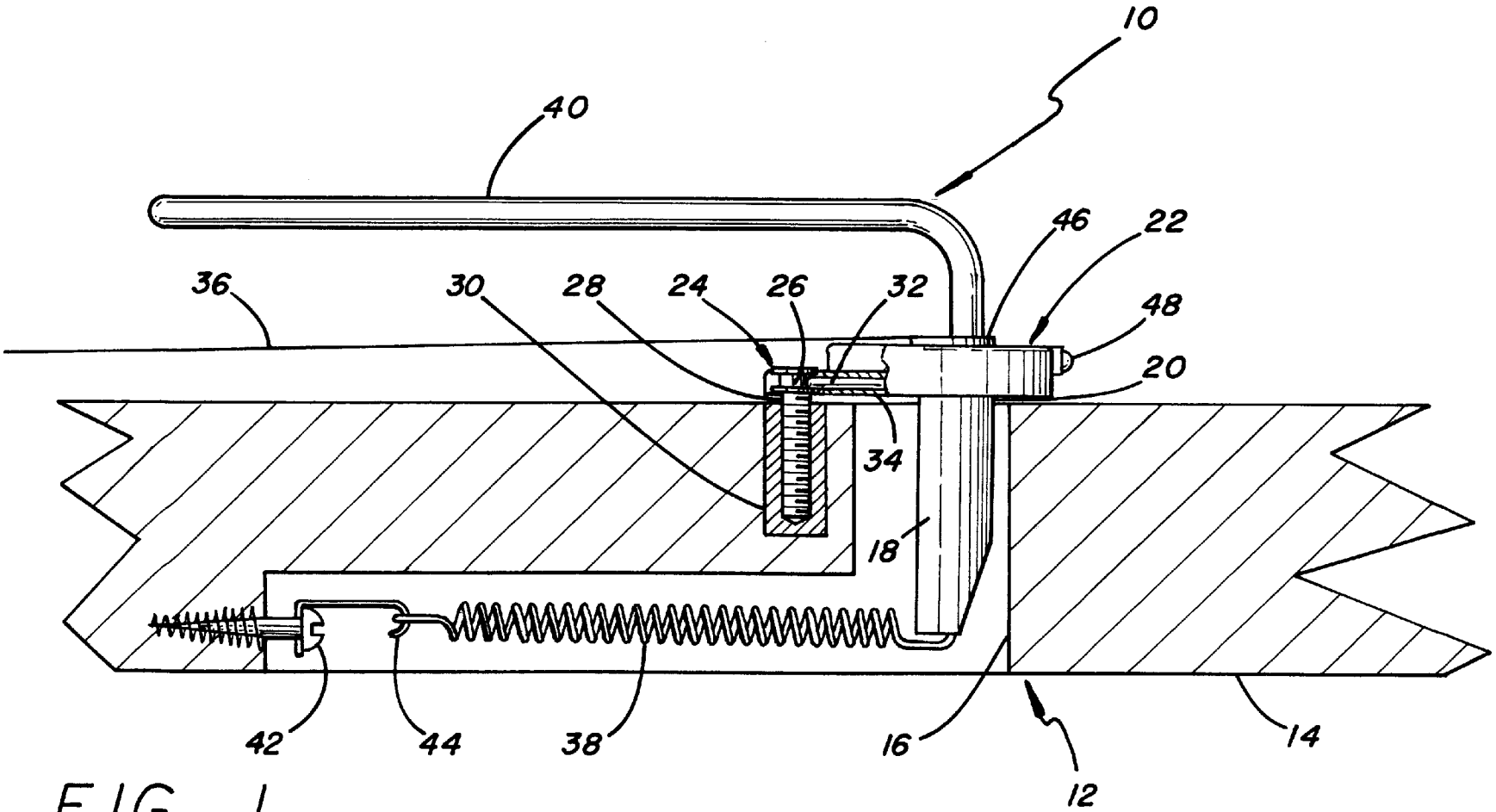
FIG. 1 is a side view, partially in section and partially in cut-away, of a tremolo bridge bearing system in accordance with the invention embodied in a guitar.

Referring to FIG. 1 of the drawings, there is shown by way of example a tremolo bridge system 10 incorporated in a guitar 12. A guitar body 14 is provided with an opening 16 receiving a bridge block 18. A bridge plate 20 is attached to the bridge block, or alternatively the block is formed unitary with the plate, for example by a casting process. The bridge block and bridge plate together form a floating bridge 22. The floating bridge is supported by bearing posts 24 which each comprise a bearing seat portion 26 and a threaded shank 28 which is received in a threaded insert 30 pressed into the guitar body 14. The seat portions 26 of the posts are formed of hardened steel in the illustrative embodiment. Cooperating with the bearing seats are rockers comprising rocker inserts 32, also formed of hardened steel which are received in sockets 34 in the bridge plate portion of the floating bridge. As is known in the art, the bearing posts resist forces applied to the floating bridge by tensioned guitar strings 36 and at least one counterbalancing spring 38. A vibrato effect is achieved by rocking the floating bridge on the bearing posts by actuation of a lever 40 attached to the floating bridge.

The counterbalancing spring 38 is anchored conventionally, for example by a screw fastener 42 and bracket 44. Each guitar string 36 is anchored in the floating bridge 22 using an adjustable block 46 positioned by a cooperating threaded positioning screw 48. These can be better appreciated with reference to FIG. 2.

Figure 2:
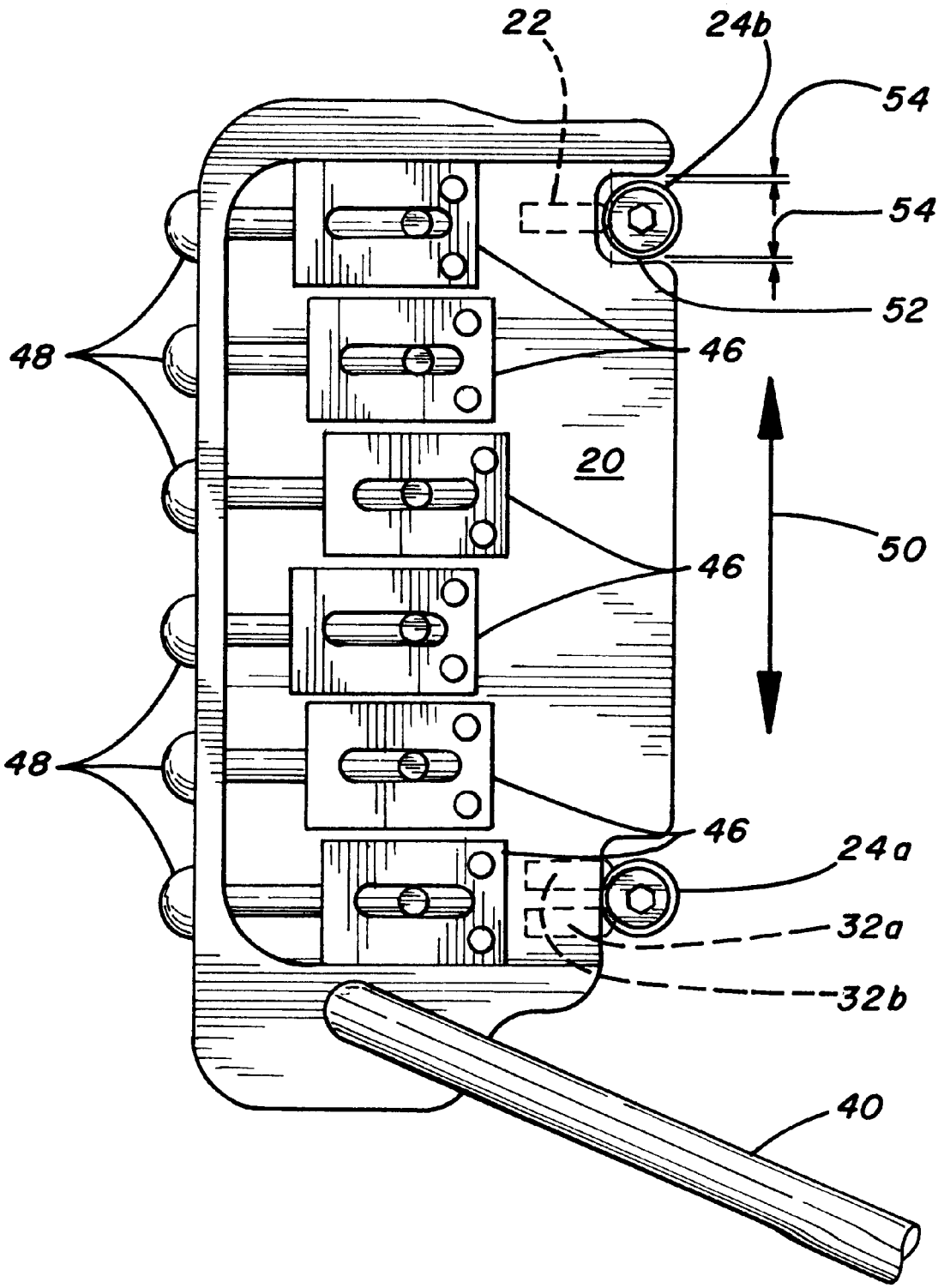
FIG. 2 is a top view of a tremolo bridge and bearing posts as they would be configured when mounted on a guitar.

As can also be seen with reference to FIG. 2, the floating bridge 22 is stabilized with regard to movement in either of two opposite directions parallel to a line 50 transverse to the orientation of the strings (not shown) due to provision of two rocker inserts 32*a*, 32*b* adjacent one of the bearing posts 24*a*. These two rocker inserts straddle the bearing post, providing resistance to transverse translational movement, but allow rocking motion of the rockers with respect to the bearing posts. The other rocker 32*c* contacts the other bearing post 24*b* approximately in the center of the post. In the illustrated embodiment the bearing post (24*a*) closest to the lever 40 which is used by a guitar player to move the floating bridge is contacted by two rockers. However, the configuration can be reversed, placing the two rockers astride the bearing post at the bearing post 24*b* opposite and the single rocker nearest the lever.

A U-shaped cut-out configuration 52 is provided in the bridge plate portion 20 of the floating bridge 22. This configuration serves to prevent the floating bridge from translating completely off the bearing posts 24, for example as the result of a strong impact or jolt to the lever 40 such as that attendant dropping of the instrument. In the event of such a displacement the configuration makes re-centering the floating bridge with respect to the opposite directions of movement along the line 50 transverse to the strings a simple matter. A clearance 54 provided on either side of the post between the post, and the bridge plate is made small enough that the adjacent rocker 32*c*, and at least one of the two rocker inserts 32*a*, 32*b*, will remain on the bearing posts 24*a*, 24*b* should a displacement from a centered position occur. The floating bridge will be moved back into position due to tension in spring 38 and the strings pulling the two rockers 32*a* & *b* stradling one bearing post 24*a* back to a central position.

Figure 3:
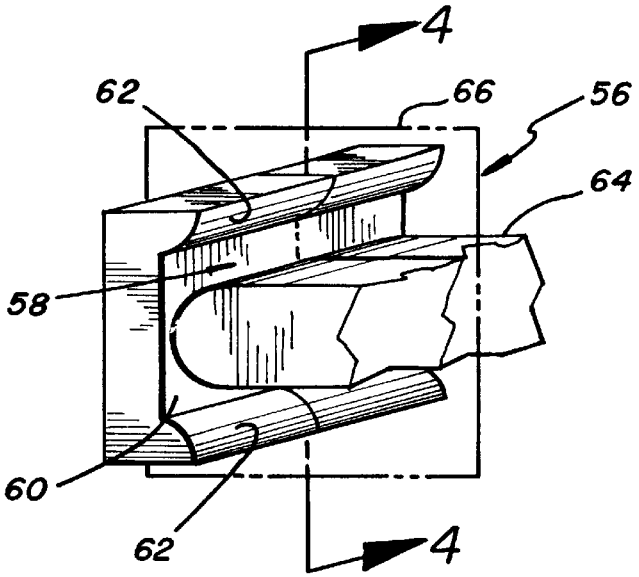
FIG. 3 is a perspective view of another embodiment of a bearing according to the invention.
Figure 4:
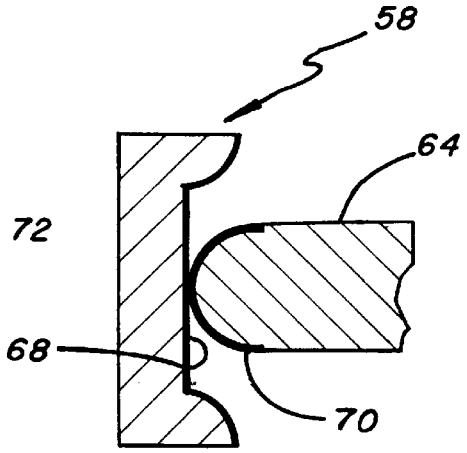
FIG. 4 is a cross section view taken along line 4—4 in FIG. 3 of the bearing shown in FIG. 3.

With reference to FIGS. 3 and 4 some principles of operation of a bearing 56 as can be used in the tremolo bridge system of the present invention are illustrated. A bearing seat 58 is provided which has a flat face comprising a bearing surface 60 and confining surface portions 62 adjacent above and below the bearing surface. A rocker 64 can rock on the bearing surface with minimal resistance due to the geometry. The intersection of an imaginary plane 66 and the bearing shown in FIG. 3 gives two lines 68, 70 (defining the outline of the bearing surface rocker) in the immediate vicinity of the point of intersection 72 of the rocker and bearing surface. The line 68 defined by the intersection of the imaginary plane and the bearing surface is a straight line. The line 70 defined by the intersection of the imaginary plane and the rocker is a continuous curve, in the illustrated embodiment it being a circular arc. As the rocker rocks back and forth the point of intersection 72 moves up and down on the straight line 68 in the imaginary plane 66. In principle all bearing configurations satisfying the following condition: that an intersection of an imaginary plane with such a bearing through the point of intersection where the path of the point of intersection as the rocker rocks back and forth lies in the imaginary plane gives a line and a continuous curve, will function in a similar way. As can be appreciated, in actuality the contact between the illustrated rocker and the seat is a line rather than a point, but the contact will appear as a point, just as the surfaces appear to be lines, in the before-mentioned imaginary plane.

Depending on the shape of the continuous curve 70 different characteristics of the system can be achieved however. For example, a circle gives a smooth rolling action, whereas another shape can provide a "camming" action moving the bridge closer to or farther from the bearing surface as the rocker rolls on the surface. This could be used for example to provide additional tactile feedback, or in other words alter the "feel" of the system to the player as the tremolo bridge system is used. It could also be used to provide a biasing action to a particular point on the curved surface 70 for the intersection point 72. This requires that the tension in the strings and counterbalancing spring be carefully adjusted so that the neutral or "in-tune" position corresponds with this point to which curve shape biases the intersection. A circular curve has the advantage of allowing some latitude in location of the neutral or "in-tune" point of intersection, and for most applications is preferred.

In principle it does not matter if the bearing surface 60 is carried by the guitar body (not shown) or if the bearing is reversed and the rocker is carried by the guitar body. In a presently preferred embodiment the rocker 64 is carried by the bridge and the bearing surface by the guitar body.

Figure 5:
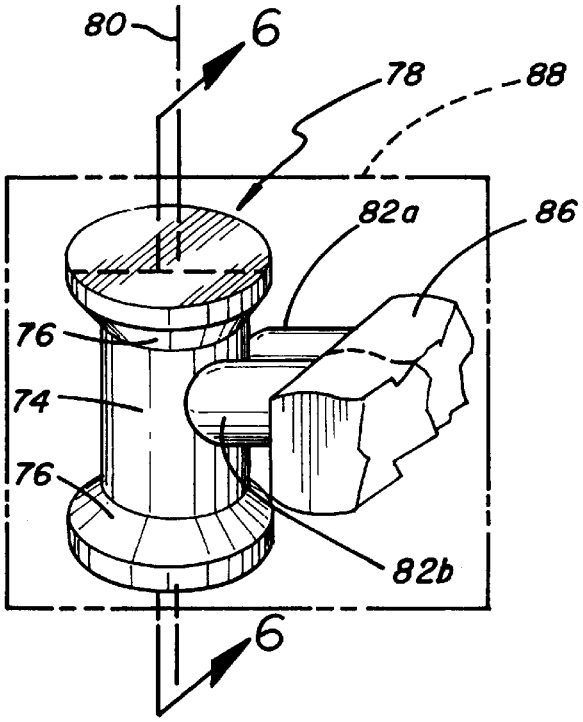
FIG. 5 is a perspective view of a portion of a bearing system in accordance with the invention.
Figure 6:
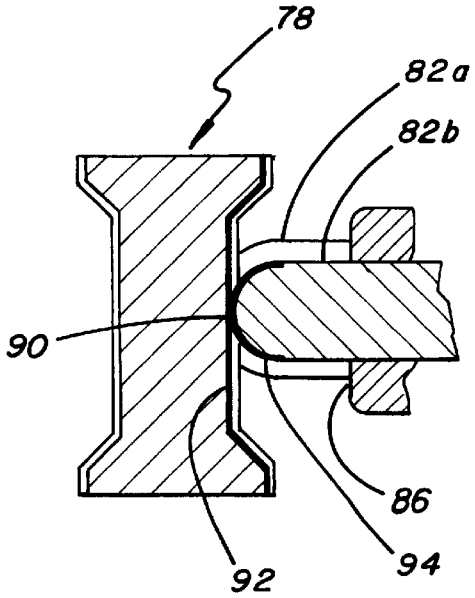
FIG. 6 is a cross section view taken along line 6—6 in FIG. 5 of the bearing shown in FIG. 5.

With reference to FIGS. 5 and 6 it can be appreciated that the illustrated embodiment shown in FIGS. 1 and 2 functions as discussed above though the bearing surface 74 is cylindrical rather than planar. Confining surface portions 76 are provided and the bearing seat 78 is symmetrical with respect to a cylindrical axis 80. The rockers 82*a* and 82*b* shown are of spherical configuration where they contact the bearing surface, rather than cylindrical as shown in FIGS. 3 and 4. Whereas the contact between rocker and seat in the embodiment shown in FIGS. 3 and 4 approximates a line, the contact between each rocker and the seat in the embodiment shown in FIGS. 5 and 6 approximates a point. In the bearing system 84 shown in FIGS. 5 and 6 the bearing plate 86 holds the two rockers, one of which (82*b*) is intersected by an imaginary plane 88 through a point of contact 90 between the rocker and the bearing surface. As the rocker rocks back and forth the point of contact, which is the point of intersection between a line 92 and a curve 94, moves up and down in the imaginary plane. The path of movement is along the straight line 92 best appreciated with reference to FIG. 6. The intersection of the spherical portion of the rocker and the imaginary plane gives the curve 94 a circular configuration. As will be further explained below the confining surface portions 76 serve to keep the rocker on the straight portion of the line 92.

Figure 8:
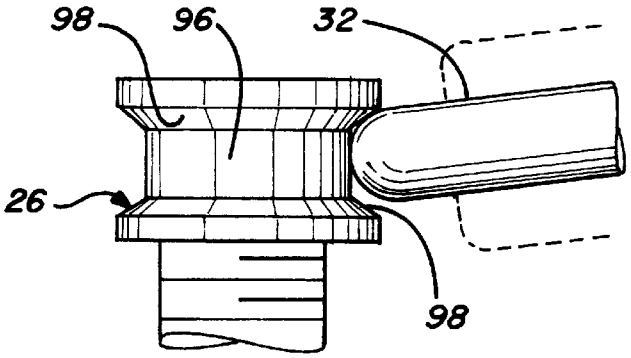
FIG. 8 is an enlarged side view of a portion of the bearing system indicated with the circular line 8—8 in FIG. 7.
Figure 7:
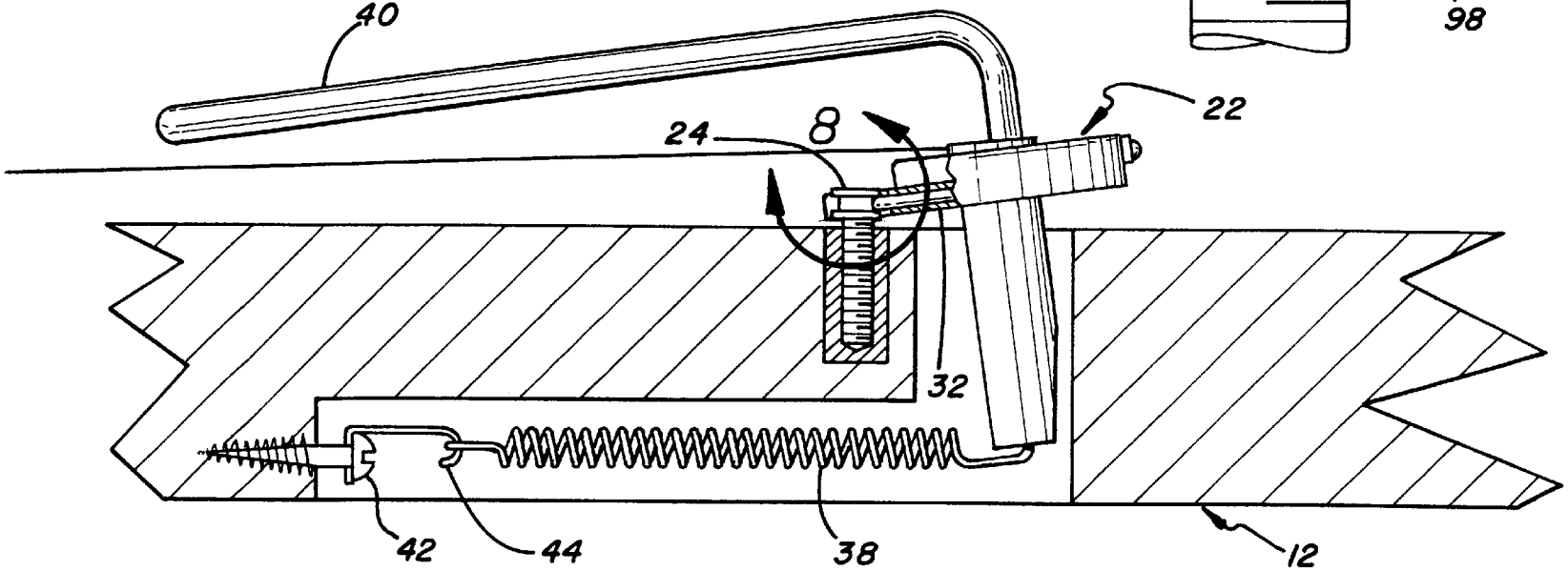
FIG. 7 is a side view of the bridge bearing system shown in FIG. 1 illustrating an aspect of its operation.

Referring to FIGS. 7 and 8, when the floating bridge 22 is mounted on the guitar 12 the rockers 32 may not be centered on a bearing surface 96 of the bearing seat portion 26 of the bearing post 24. By actuating the lever 40 the rocker can be made to roll up against confining surface portions 98. Due to the configuration of the confining surface portions, (particularly the abrupt change in the orientation of the surface that the confining surface portions embody) the rocker slips, rather than rolling further up or down the bearing post. This slippage sets or resets the relationship of the rocker to the bearing surface portion so that the rocker will then roll back away from the confining surface portions to a more central location on the bearing surface. The next time the lever is pulled or pushed to an extreme end of its range of motion the rocker will only just touch the confining surface portion. Consequently the bearing system in essence resets itself for free rocking motion each time the lever is pushed or pulled to the extreme end of its range of motion. Other than at initial installation, the bearings can require such self adjustment as a result of cumulative creep of the position of the rocker with respect to the post due to hard playing, or displacement due to an impact to the instrument; but otherwise the rockers roll up and down on the bearing surface with minimal resistance, never touching the confining portions.

Figure 10:
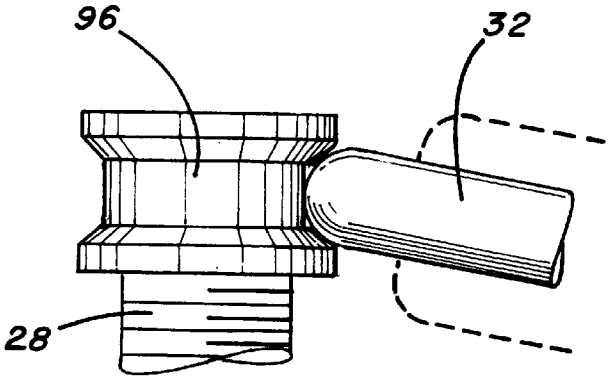
FIG. 10 is an enlarged side view of a portion of the bearing system indicated with the circular line 10—10 in FIG. 9.
Figure 9:
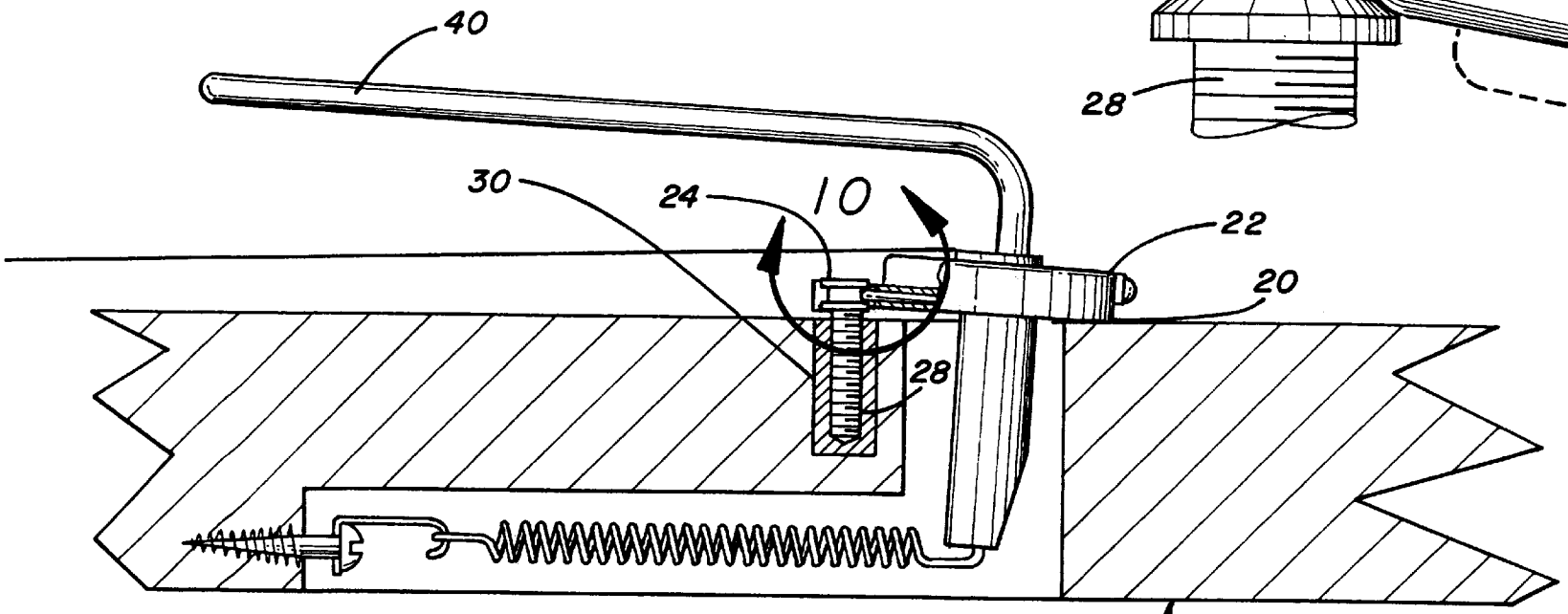
FIG. 9 is a side view of the bridge bearing system shown in FIG. 1 illustrating an aspect of its operation.

For example, with reference to FIGS. 9 and 10 it can be appreciated that the rocker 32 is in a position to roll freely to the other extreme of the range of motion of the lever 40 after such self-adjustment. In normal operation the rocker simply rolls back and forth on the bearing surface 96 with minimal resistance as the lever is actuated by the player. Likewise the roller returns to the original neutral balance or "in-tune" position with minimal resistance. Because the bearing rolls in this way, wear is minimized. The roller and bearing post can be made of very hard materials.

The rockers 32 are made as inserts so that they can be formed of hardened steel for example, or other very hard material, while not requiring that the rest of the floating bridge be formed of such a hard material. Unlike knife-edge bearings for example, where at least the bridge plate 20 was made of hardened steel as it conventionally incorporated knife edges, the illustrated embodiment of the present invention allows for the use of aluminum, for example, or other materials, as only the insert will be subjected to the high stresses inherent in the configuration. Materials can be chosen for other properties, such as how they might effect the tone of the instrument, in constructing the bridge 22, rather than the overriding consideration of strength so important to prior knife-edge bearing configurations.

The bearing posts 24 are configured to fit into standard-size sockets of existing guitars, for example embodied in the threaded inserts 30 illustrated in FIG. 9. With reference to both FIGS. 9 and 10, the bearing posts are symmetrical with respect to the longitudinal axis in the bearing post seat portion 26, and interchangeable. Symmetry in the bearing seat portion allows them to be adjusted up or down by rotation due to interaction of the threaded shank 28 with the threaded insert. Also, a slight rotation of both bearing posts results in fresh bearing surfaces 96 being presented to the rockers 32, lengthening service life as a damaged portion (not shown) of the bearing seat 96 for example can be rotated out of the way.

The bearing system in accordance with the present invention allows adapting existing guitars having standardized threaded sockets to the improved bearing system. Simple replacement of the floating bridge and bearing posts with bearing posts 24 and a floating bridge of the invention 22 implements the changeover, and the system can be sold as a kit including replacement bearing posts and a floating bridge with associated hardware for example. Whether used in a new instrument, or as a retro-fit of an older guitar, the advantages of long wearing bearings, smooth reliable action and return to the in-tune position, enablement of use of softer materials for the bridge plate 20 and/or bridge block 18 and interchangability of the rocker inserts 32 and bearing posts 24, and other advantages apparent from the forgoing discussion are obtained by use of the present invention. Cost savings in manufacture and use are also possible due for example to enablement of substitution of other materials for the hardened steel formerly used, and longer wear of the bearings due to their improved design.

While the above description sets forth particular presently preferred embodiments of the invention, it will be understood that it is given by way of example and not by way of limitation. It will be appreciated that various modifications, changes and substitutions can be made without departing from the spirit and scope of the invention as set forth in, and according to, the proper scope and fair meaning of the appended claims.

I claim:

1. A bearing system for a tremolo bridge of a guitar, comprising:

a bearing surface mountable on a body of a guitar;

a rocker mountable on the tremolo bridge, said rocker defining a rocker surface contactable to and cooperating with said bearing surface to provide smooth movement of the tremolo bridge; the bearing surface and the rocker surface being configured so that in an assembled bearing system on a guitar an imaginary plane intersecting the surfaces through a point of contact between them defines two lines having a point of contact at the intersections of the plane with the surfaces, the line defined by the intersection of the imaginary plane with the bearing surface being straight adjacent the point of contact and the line defined by the intersection of the imaginary plane with the rocker surface defining a continuous curve adjacent the point of contact, whereby a smooth rocking action with minimal resistance is facilitated.

2. The bearing system of claim 1, further comprising a confining surface portion adjacent the bearing surface configured for preventing the rocker from rolling off the bearing surface.

3. The bearing system of claim 1, wherein the line defined by the intersection of the imaginary place with the rocker surface is a circular arc.

4. The bearing system of claim 1, wherein the rocker surface is spherical.

5. The bearing system of claim 1, wherein the bearing surface is cylindrical.

6. The bearing system of claim 5, further comprising a further rocker surface spaced apart from the rocker surface, the two rocker surfaces cooperating with the bearing surface to stabilize the bridge so as to minimize translational movement of the bridge with respect to the bearing surface in a direction orthogonal to a pivot axis about which the rocker surfaces rotate with respect to the bearing surface.

7. The bearing system of claim 1, wherein contact between the bearing surface and the rocker element surface is a single point.

8. The bearing system of claim 1, wherein the bearing surface is carried by a bearing post.

9. The bearing system of claim 8, wherein the bearing post is adjustable in height with respect to the guitar body.

10. The bearing system of claim 9, wherein the post is threaded and received in a threaded receptacle in the guitar body, height adjustment being facilitated by rotating the post.

11. The bearing system of claim 10, wherein the bearing surface comprises a right circular cylinder.

12. The bearing system of claim 1, wherein said rocker further comprises a bearing insert received in a socket in the tremolo bridge.

13. A guitar tremolo bridge bearing system supporting a tremolo bridge, comprising:

a bearing surface carried by a guitar body, said bearing surface being configured such that the intersection of said bearing surface and at least one plane gives a line having a straight central portion intermediate two confinement portions which diverge from the straight central portion to define a valley shape having a flat bottom and confining sides;

a rocker in rolling contact with the bearing surface, the rocker defining a rocker surface in contact with said bearing surface, said surface being configured such that the intersection of the at least one plane with said surface defines a line which is continuous and curves smoothly, said rocker being carried by the tremolo bridge, the rocker cooperating with the bearing surface to provide a smooth rolling action in allowing the tremolo bridge to rock back and forth on the tremolo bridge bearing from a first neutral balance position.

14. A bridge bearing system according to claim 13, wherein said confinement portions are configured so that the bearing system will be self-adjusting regarding positioning of the rocker element surface and the bearing surface.

15. The bridge bearing system of claim 13, wherein the intersection of the imaginary plane and the rocker surface where rocker surface intersection with a plane defines a circular arc.

16. The bridge bearing system of claim 15, wherein the rocker surface is spherical.

17. The bridge bearing system of claim 13, wherein the bearing surface comprises a central cylindrical portion.

18. The bridge bearing system of claim 17 wherein the central cylindrical portion defines a right circular cylinder.

19. The bridge bearing system of claim 13, wherein the bearing surface is carried by a bearing post of adjustable height in relation to the guitar body.

20. The bridge bearing system of claim 19, wherein the bearing post further includes a threaded portion configured for threading into the guitar body.

21. The bridge bearing system of claim 20, wherein the bearing surface has an axis of symmetry and the bearing post has an axis of symmetry coaxial with that of the bearing surface, the central portion of the bearing surface comprising a right circular cylinder and the confinement portions bounding the central portion comprising frustoconical surfaces.

22. The bearing system of claim 17, comprising a further rocker surface cooperating with said rocker surface and the bearing surface to resist movement of the tremolo bridge in a direction orthogonal to the cylindrical axis of the bearing surface.

23. The bearing system of claim 13, wherein the rocker comprises an insert received in a socket defined by the tremolo bridge.

24. The bearing system of claim 13, wherein the contact between the bearing surface and the rocker surface comprises a discrete point.

25. A tremolo bridge support bearing system for a guitar, comprising:

a support post carried by a guitar, the support post further comprising a bearing seat surface segment having a longitudinal axis and a first end and a second end, the bearing seat segment further comprising a first frustoconical segment having a decreasing radius along the longitudinal axis in a direction from the first end of the bearing segment to the second end of the bearing segment, and a second frustoconical segment having an increasing radius along the longitudinal axis in a direction from the first end of the bearing segment to the second end of the bearing segment, and a right circular cylindrical segment intermediate the first and second frustoconical segments;

a rocker having a curved surface in contact with the bearing seat surface segment of the support post, the rocker being carried by the tremolo bridge and facilitating a smooth relative movement between the bridge and the guitar body to provide a tremolo effect.

* * * * *